US008131164B2

(12) United States Patent
Tomiyori et al.

(10) Patent No.: US 8,131,164 B2
(45) Date of Patent: Mar. 6, 2012

(54) PROCESSING UNIT AND IMAGE FORMING APPARATUS

(75) Inventors: Minoru Tomiyori, Osaka (JP); Hideaki Kadowaki, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 439 days.

(21) Appl. No.: 12/542,465

(22) Filed: Aug. 17, 2009

(65) Prior Publication Data

US 2010/0054763 A1 Mar. 4, 2010

(30) Foreign Application Priority Data

Aug. 28, 2008 (JP) ..... 2008-219976
Aug. 28, 2008 (JP) ..... 2008-219977

(51) Int. Cl.
*G03G 15/00* (2006.01)

(52) U.S. Cl. ..... 399/12; 399/110

(58) Field of Classification Search ..... 399/12, 399/13, 110, 111, 113
See application file for complete search history.

(56) References Cited

U.S. PATENT DOCUMENTS

| | | | | |
|---|---|---|---|---|
| 6,154,619 | A * | 11/2000 | Boockholdt et al. | 399/24 |
| 2006/0193645 | A1* | 8/2006 | Kishi | 399/12 |
| 2007/0048007 | A1 | 3/2007 | Kamimura | |
| 2007/0122165 | A1* | 5/2007 | Igarashi et al. | 399/12 |
| 2008/0205911 | A1* | 8/2008 | Ishikawa et al. | 399/12 |
| 2009/0000423 | A1* | 1/2009 | Ishikawa et al. | 74/606 R |

FOREIGN PATENT DOCUMENTS

| | | | |
|---|---|---|---|
| JP | 7-160173 | A | 6/1995 |
| JP | 9-281766 | A | 10/1997 |
| JP | 10-3241 | A | 1/1998 |
| JP | 10-39600 | A | 2/1998 |
| JP | 2001-92194 | A | 4/2001 |
| JP | 2002-139976 | A | 5/2002 |
| JP | 2003-84646 | A | 3/2003 |
| JP | 2003-107976 | A | 4/2003 |
| JP | 2003-316227 | A | 11/2003 |
| JP | 2006-163304 | A | 6/2006 |
| JP | 2006-235236 | A | 9/2006 |
| JP | 2007-58067 | A | 3/2007 |
| JP | 2007-148285 | A | 6/2007 |

* cited by examiner

*Primary Examiner* — David Gray
*Assistant Examiner* — Rodney Bonnette
(74) *Attorney, Agent, or Firm* — Birch, Stewart, Kolasch & Birch, LLP

(57) ABSTRACT

A processing unit according to this invention includes a photosensitive drum, an initial detection gear, a rotation stop, and a stopper arm. The photosensitive drum forms an electrostatic latent image on a surface thereof. The initial detection gear is a member which is rotatable in a manner linked to rotation of the photoreceptor for identifying the processing unit as a new one or an old one. The rotation stop is provided on the photosensitive drum. The stopper arm is engageable with the rotation stop.

11 Claims, 18 Drawing Sheets

PROCESSING UNIT AND IMAGE FORMING APPARATUS

CROSS REFERENCE

This Nonprovisional application claims priority under 35 U.S.C. §119(a) on Patent Application No. 2008-219976 filed in Japan on Aug. 28, 2008, and Patent Application No. 2008-219977 filed in Japan on Aug. 28, 2008 the entire contents of which are hereby incorporated by references.

BACKGROUND OF THE INVENTION

The present invention relates to a processing unit and an image forming apparatus including such a processing unit.

A consumable part used in an electrophotographic image forming apparatus reaches the end of its life for replacement some day with frequency of use. Such occasions include: an occasion at which toner in the container of a toner cartridge to be supplied has run out; an occasion at which a developer used in a processing unit has been deteriorated in durability; and a waste toner container has been filled up with water toner.

In general, an image forming apparatus is configured to detect a consumable part of which the lift has reached its end and prompt the user to replace the consumable part with a new one. One of such configurations is a configuration provided with a new/old detection mechanism for identifying a consumable part as a new one or an old one. A conceivable method of detecting the end of life of a consumable part by such a new/old detection mechanism includes: providing the consumable part with an electrical memory device; and writing information into the memory device. However, such a method raises a problem of an increased running cost because a semiconductor memory device is very expensive and, hence, the consumable part itself becomes expensive.

In view of this problem, an image forming apparatus is disclosed which employs a relatively inexpensive new/old detection mechanism without using any expensive member such as a semiconductor memory device (see Japanese Patent Laid-Open Publication No. 2003-316227).

In maintaining a high image quality, the time to replace a consumable part used in an image forming apparatus, particularly the time to replace a processing unit, is critical. Demands exist for further downsizing of image forming apparatus. With downsizing of such an image forming apparatus, the processing unit for use therein has to be downsized also. Accordingly, the new/old detection mechanism for identifying the processing unit as a new one or an old one has to be downsized also. The new/old detection mechanism described in Japanese Patent Laid-Open Publication No. 2003-316227, however, has a problem that new/old detection mechanism cannot accommodate to the downsizing of the processing unit because of its complicated configuration. Further, upon replacement of the processing unit the image forming apparatus has to correctly identify the replacing processing unit as a new one. With the technique described in Japanese Patent Laid-Open Publication No. 2003-316227, however, an inconvenience occurs such that if the gear of the new/old detection mechanism is rotated by accident during the operation of fitting the processing unit on the image forming apparatus, the processing unit cannot be identified as a new one by the image forming apparatus even though the processing unit is a new one.

In view of the foregoing problems, the present invention intends to provide a processing unit which enables an image forming apparatus to correctly identify the processing unit as a new one or an old one even though the image forming apparatus is downsized.

SUMMARY OF THE INVENTION

A processing unit according to the present invention includes a photoreceptor, a new/old detection member, a rotation stop, and a stopper.

The photoreceptor is configured to form an electrostatic latent image on a surface thereof. The new/old detection member has an acting portion which rotates irreversibly through a fixed angle in a manner linked to rotation of the photoreceptor when a processing unit body including the photoreceptor is fitted on an image forming apparatus body. The new/old detection member is a member enabling the image forming apparatus body to identify the processing unit as a new one or an old one according to whether or not the acting portion is detected by the image forming apparatus body. The expression "to rotate irreversibly through a fixed angle", as used in the present invention, means that the acting portion cannot rotate backwardly after having rotated by the fixed angle and fails to rotate through a larger angle than the fixed angle. The rotation stop is provided on the photoreceptor. The stopper prevents the photoreceptor from rotating by engaging the rotation stop.

The foregoing and other features and attendant advantages of the present invention will become more apparent from the reading of the following detailed description of the invention in conjunction with the accompanying drawings.

DETAILED DESCRIPTION OF THE INVENTION

Hereinafter, a processing unit according to a best mode for carrying out the present invention and an image forming apparatus including the processing unit will be described in detail with reference to the attached drawings.

Figure 1:
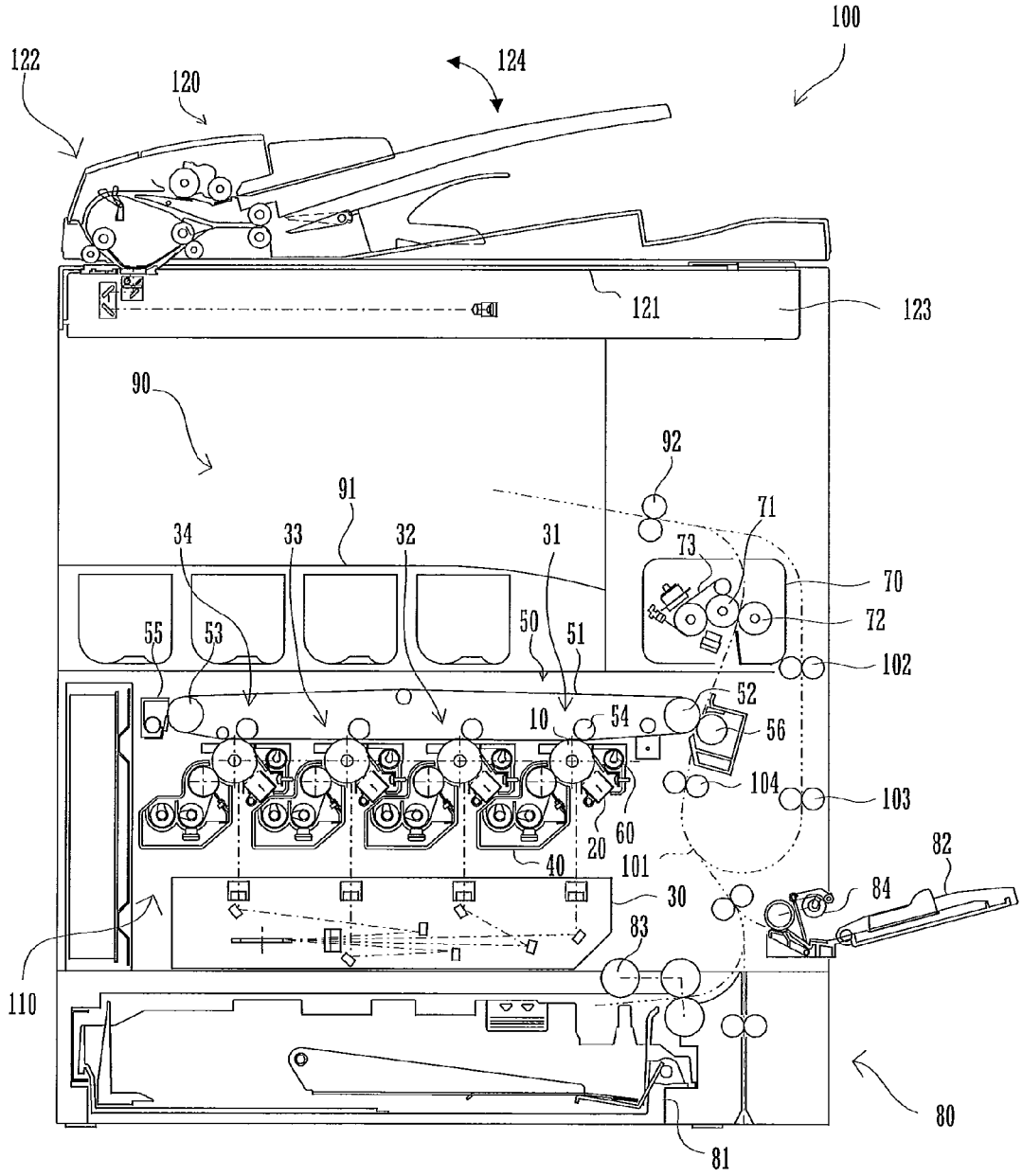
FIG. 1 is a view illustrating a configuration of an image forming apparatus according to an embodiment of the present invention.

FIG. 1 is a view illustrating a configuration of an image forming apparatus according to an embodiment of the present invention.

An image forming apparatus 100 is configured to form a polychrome or monochrome image on a predetermined sheet (i.e., recording sheet) in accordance with image data transmitted thereto from the outside. The image forming apparatus 100 includes a document processing device 120, a sheet feeding section 80, an image forming section 110, and a sheet delivery section 90.

The document processing device 120 includes a document platen 121, a document feeder 122, and a document reading section 123. The document platen 121 is formed of transparent glass and is configured to allow a document to be placed thereon. The document feeder 122 feeds document sheets carried on a document tray one by one. The document feeder 122, which is capable of pivoting in a direction indicated by arrow 124, allows the document to be placed on the document platen 121 by exposing the top surface of the document platen 121. The document reading section 123 reads a document sheet being fed by the document feeder 121 or the document placed on the document platen 122.

The sheet feeding section 80 includes a sheet feed cassette 81, a manual feed cassette 82, and pickup rollers 83 and 84. The sheet feed cassette 81 is a tray for holding standard size sheets thereon. The manual feed cassette 82 is a tray capable of receiving non-standard size sheets thereon. The pickup roller 83, which is located adjacent an end portion of the sheet feed cassette 81, picks up sheets one by one from the sheet feed cassette 81 to feed each sheet to a sheet feed path 101. Likewise, the pickup roller 84, which is located adjacent an end portion of the manual feed cassette 82, picks up sheets one by one from the manual feed cassette 82 to feed each sheet to the sheet feed path 101.

The image forming section 110 includes image forming stations 31 to 34, an exposure unit 30, an intermediate transfer belt unit 50, and a fixing unit 70. The image forming stations 31 to 34 are each provided with a photosensitive drum 10, an electrostatic charger device 20, a developing device 40, and a cleaner unit 60. The image forming stations 31 to 34 each correspond to a respective one of color images formed using respective colors, i.e., black (K), cyan (C), magenta (M) and yellow (Y). In the present embodiment, description is directed to the image forming station 31.

The photosensitive drum 10 rotates during image formation and is configured to carry a developer image thereon. Around the photosensitive drum 10, there are disposed the electrostatic charger device 20, exposure unit 30, developing device 40, intermediate transfer belt unit 50 and cleaner unit 60 in this order from an upstream side in the direction of rotation of the photosensitive drum 10. The fixing unit 70 is provided on the sheet feed path 101 at a location most downstream in the image forming section 110.

The electrostatic charger device 20 is means for electrostatically charging a peripheral surface of the photosensitive drum 10 to a predetermined potential uniformly. Besides an electrostatic charger device of the charger type as shown in FIG. 1, a contact-type electrostatic charger device using a roller or a brush may be used.

The exposure unit 30 has a function of exposing the photosensitive drum 10 in an electrostatically charged state to light according to image data inputted, thereby forming an electrostatic latent image according to the image data on the peripheral surface of the photosensitive drum 10. The exposure unit 30 is constructed as a laser scanning unit (LSU) having a laser emitting section, a reflecting mirror and the like. In the exposure unit 30, there are disposed a polygon mirror for laser beam scanning, and optical components, such as a lens and a mirror, for directing laser light reflected by the polygon mirror to the photosensitive drum 10. The exposure unit 30 may employ a technique using a writing head having an array of other light-emitting devices, such as ELs or LEDs for example.

The developing device 40 is configured to visualize the electrostatic latent image formed on the photosensitive drum 10.

The intermediate transfer belt unit 50 includes an intermediate transfer belt 51, an intermediate transfer belt driving roller 52, an intermediate transfer belt driven roller 53, an intermediate transfer roller 54, and an intermediate transfer belt cleaning unit 55.

The intermediate transfer belt driving roller 52, intermediate transfer belt driven roller 53 and intermediate transfer roller 54, about which the intermediate transfer belt 51 is entrained, drive the intermediate transfer belt 51 for rotation. The intermediate transfer roller 54 performs application of a transfer bias for transferring the toner image from the photosensitive drum 10 onto the intermediate transfer belt 51.

The intermediate transfer belt 51 is positioned so as to contact the photosensitive drum 10. The intermediate transfer belt 51 has a function of forming the toner image thereon by transfer of the toner image from the photosensitive drum 10 onto the intermediate transfer belt 51. The intermediate transfer belt 51 is formed into an endless belt by using a film having a thickness of about 100 to about 150 μm for example.

The transfer of the toner image from the photosensitive drum 10 to the intermediate transfer belt 51 is achieved by the intermediate transfer roller 54 in contact with the reverse side of the intermediate transfer belt 51. The intermediate transfer roller 54 is applied with a high transfer bias voltage (i.e., a high voltage having a polarity (+) opposite to the polarity (−) of the toner charged) in order to transfer the toner image. The intermediate transfer roller 54 is a roller comprising a shaft of metal (e.g., stainless steel) having a diameter of 8 to 10 mm as a base, and an electrically conductive elastic material (e.g., EPDM or urethane foam) covering the surface of the shaft. The electrically conductive elastic material enables the intermediate transfer belt 51 to be uniformly applied with the high voltage. While the present embodiment uses a transfer electrode in the form of a roller, it is possible to use a transfer electrode in the form of a brush or the like.

Electrostatic latent images thus visualized on the respective photosensitive drums 10 are transferred onto the intermediate transfer belt 51 so as to be superimposed on one another. Image information obtained by superimposition of the toner images is fed by rotation of the intermediate transfer belt 51 to a contact position between a recording sheet and the intermediate transfer belt 51 and is then transferred onto the recording sheet by the transfer roller 56 disposed at the contact position.

At that time, the intermediate transfer belt 51 and the transfer roller 56 are pressed against each other at a predetermined nip pressure, while the transfer roller 56 applied with a voltage for transferring the toner to the recording sheet (i.e., a high voltage having a polarity (+) opposite to the polarity (−) of the toner charged). For obtaining the above-described nip pressure steadily, one of the transfer roller 56 and the intermediate transfer belt driving roller 52 comprises a hard material (e.g., metal or the like) and the other comprises a soft material such as an elastic roller (e.g., elastic rubber roller, expanded resin roller, or the like).

Toner thus attached to the intermediate transfer belt 51 by contact between the photosensitive drum 10 and the intermediate transfer belt 51 or residual toner remaining on the intermediate transfer belt 51 without having been transferred onto the recording sheet by the transfer roller 56, is removed and collected by the intermediate transfer belt cleaning unit 55. The intermediate transfer belt cleaning unit 55 includes, for example, a cleaning blade as a cleaning member contacting the intermediate transfer belt 51. The intermediate transfer belt 51 contacted by the cleaning blade is supported by the intermediate transfer belt driven roller 53 from the reverse side thereof.

The cleaner unit 60 removes and collects residual toner remaining on the peripheral surface of the photosensitive drum 10 after the image transfer operation following the developing operation.

The fixing unit 70 includes a heating roller 71 and a pressurizing roller 72 which are configured to rotate while nipping a sheet therebetween. The heating roller 71 is controlled by a control section based on signals from a non-illustrated temperature detector so that a predetermined fixing temperature is reached. The heating roller 71 has a function of fusing, mixing and pressure-contacting the toner image transferred to the sheet by heat-bonding the toner to the sheet cooperatively with the pressurizing roller 71, thereby fixing the toner image onto the sheet by heat. An external heating belt 73 is provided for heating the heating roller 71 from the outside.

The sheet delivery section 90 has a catch tray 91 and sheet delivery rollers 92. The recording sheet having passed through the fixing unit 70 is delivered onto the catch tray 91 by passing between the delivery rollers 92. The catch tray 91 is a tray for accumulating sheets finished with printing.

In cases where double-side printing is requested, when a sheet having been finished with one-side printing as described above and passed through the fixing unit 70 is held between the sheet delivery rollers 92 at its trailing edge, the sheet delivery rollers 92 rotate backwardly to feed the sheet to feed rollers 102 and then to feed rollers 103. Thereafter, the sheet is subjected to reverse side printing after having passed between registration rollers 104 and is then delivered onto the catch tray 91.

Figure 2:
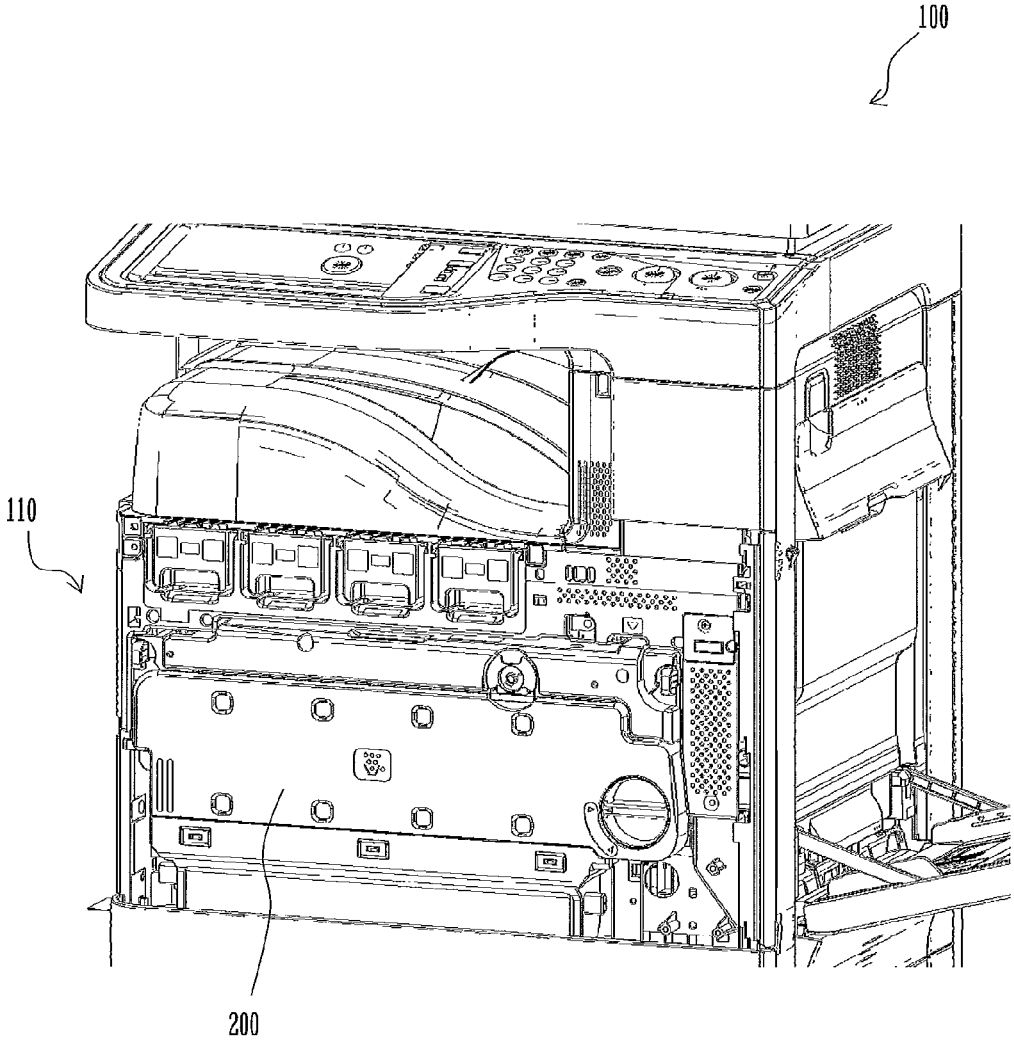
FIG. 2 is a view illustrating the image forming apparatus according to the embodiment of the present invention from which an outer frame is omitted.

FIG. 2 is a view illustrating the image forming apparatus according to the embodiment of the present invention from which an outer frame is omitted.

In the image forming apparatus 100, residual toner usually remains on the photosensitive drum 10 after transfer has been done. For this reason, the image forming apparatus 100 is provided with a cleaner unit 4 for removing such residual toner remaining on the photosensitive drum 10, and a waste toner container 200 for storing therein waste toner removed from the photosensitive drum 10 by the cleaner unit 4. The waste toner container 200 is removable from the image forming apparatus 100.

Figure 3:
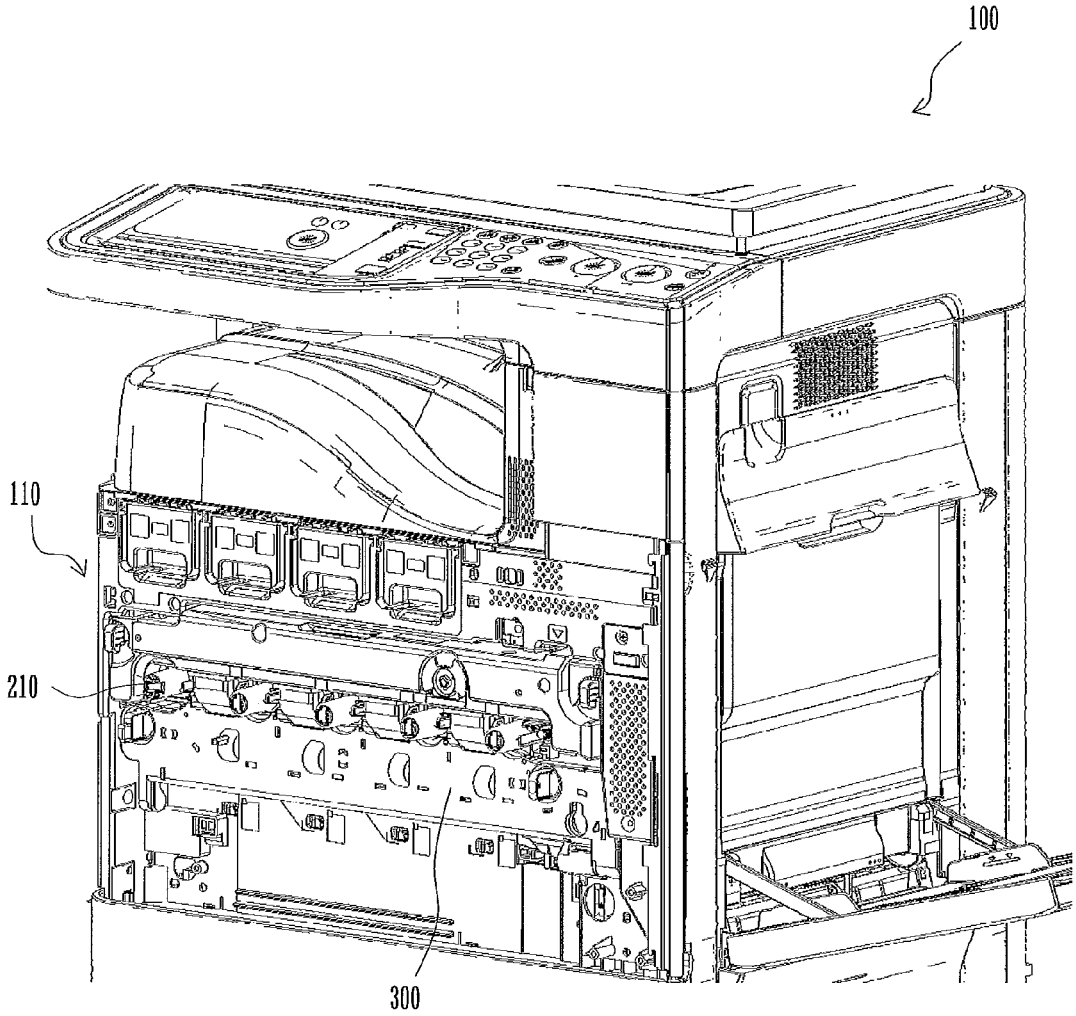
FIG. 3 is a view illustrating the image forming apparatus according to the embodiment of the present invention from which the outer frame and a waste toner container are omitted.

FIG. 3 is a view illustrating the image forming apparatus according to the embodiment of the present invention from which the outer frame and the waste toner container are omitted.

Behind the waste toner container 200, there are provided a toner discharge port 210 and a positioning unit 300. The toner discharge port 210 is a passage for carrying the waste toner removed from the photosensitive drum 10 by the cleaner unit 4 into the waste toner container 200. The positioning unit 300 is a unit for positioning a replaceable processing unit 400 including the photosensitive drum 10 relative to the image forming apparatus 100.

Figure 4:
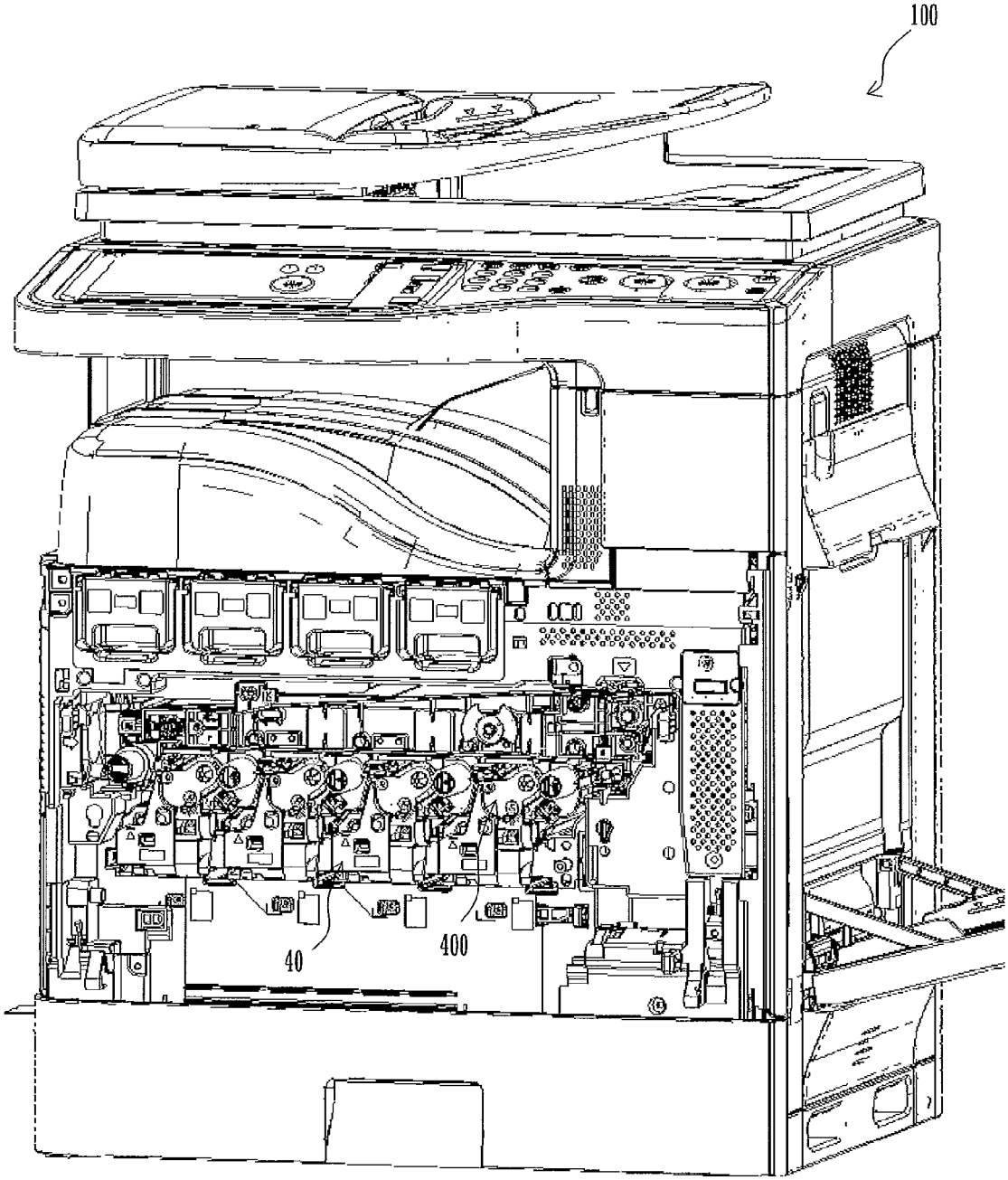
FIG. 4 is a view illustrating the image forming apparatus according to the embodiment of the present invention from which the outer frame, waste toner container and a positioning unit are omitted.

FIG. 4 is a view illustrating the image forming apparatus according to the embodiment of the present invention from which the outer frame, waste toner container and positioning unit are omitted.

Behind the positioning unit 300, there are provided the developing device 40 and the processing unit 400. The developing device 40 and the processing unit 400 are removable from the image forming apparatus 100.

Figure 5:
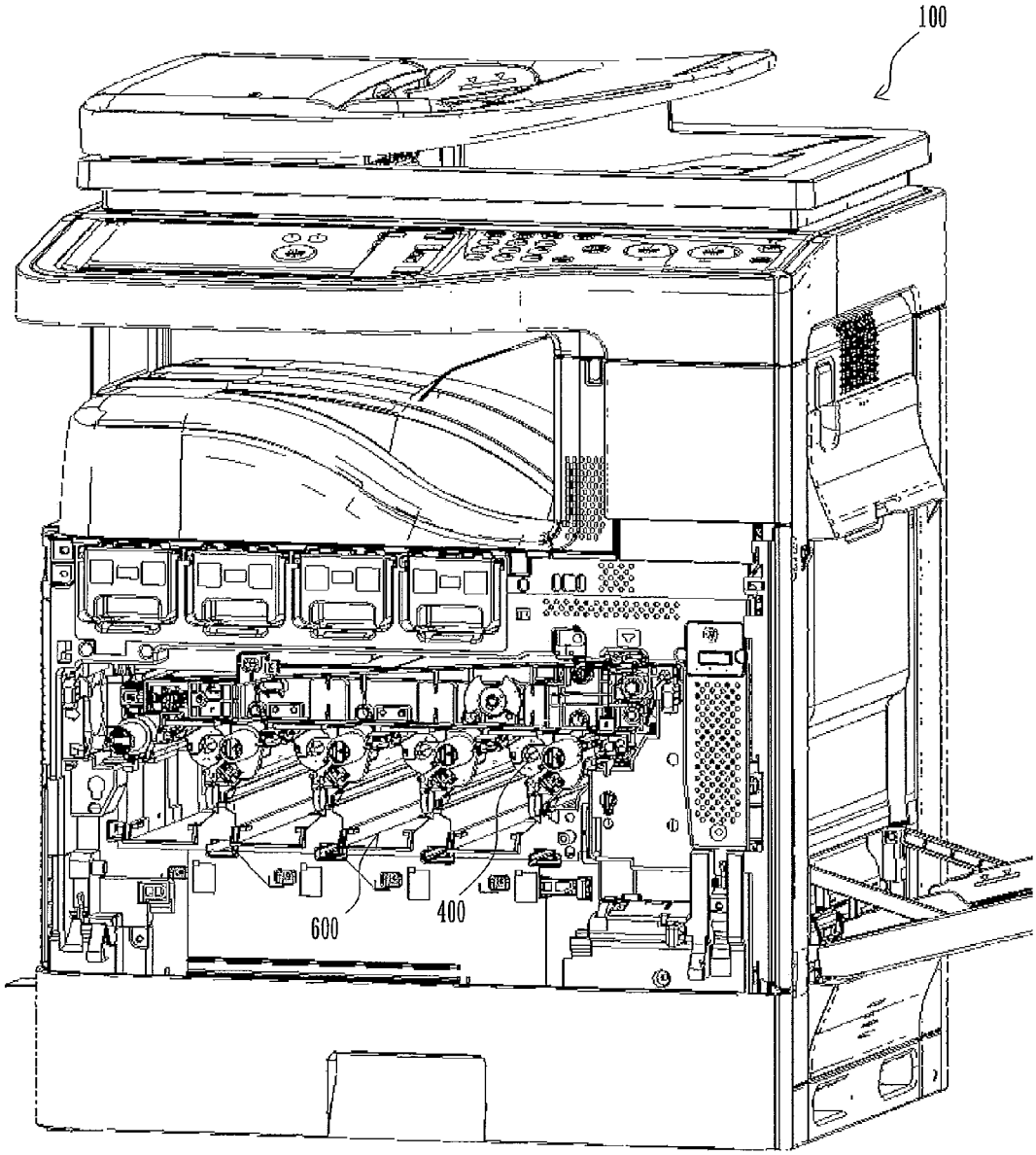
FIG. 5 is a view illustrating the image forming apparatus according to the embodiment of the present invention from which the outer frame, waste toner container, positioning unit and a developing unit are omitted.

FIG. 5 is a view illustrating the image forming apparatus according to the embodiment of the present invention from which the outer frame, waste toner container, positioning unit and a developing unit are omitted.

The image forming apparatus 100 has an open path 600. FIG. 5 illustrates a state in which the processing unit 400 is fitted on the open path 600. The processing unit 400 and the developing device 40 are removable along the open path 600. The developing device 40 is fitted on the image forming apparatus 100 after the processing unit 400 has been fitted on the image forming apparatus 100.

Figure 6:
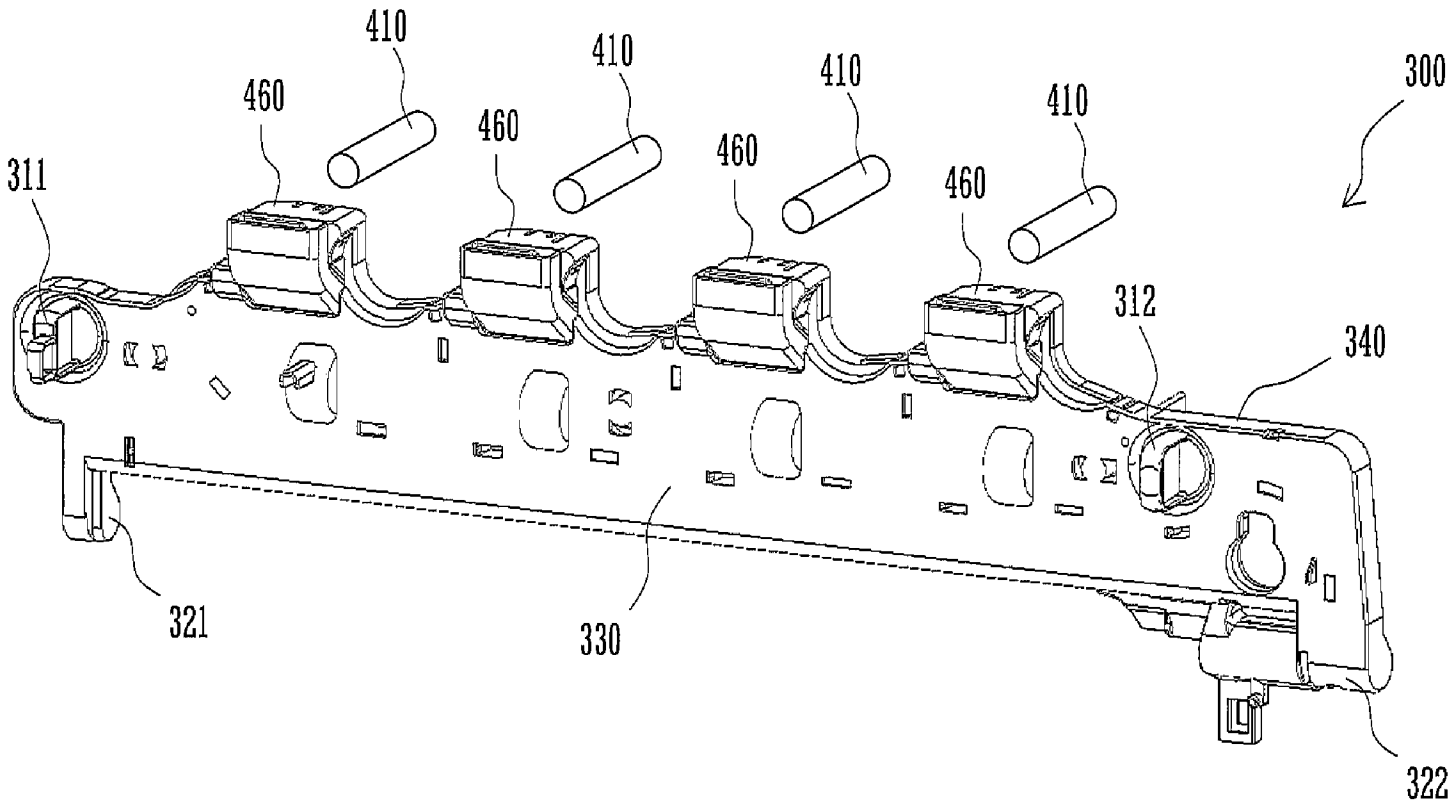
FIG. 6 is a view illustrating the positioning unit of the image forming apparatus according to the embodiment of the present invention.

FIG. 6 is a view illustrating the positioning unit of the image forming apparatus according to the embodiment of the present invention.

The positioning unit 300 is constructed of an obverse member 330 and a reverse member 340. The positioning unit 300 includes operating members 311 and 312, pivotal support members 321 and 322, and a detection switch 460. The operating members 311 and 312 and the pivotal support members 321 and 322 form an opening and closing mechanism defined by the present invention. The detection switch 460 is equivalent to a detection mechanism defined by the present invention.

The operating members 311 and 312 are each a knob to be rotated by an operator for fixing the positioning unit 300 to the image forming apparatus 100 or releasing the positioning unit 300 from the fixed state. The pivotal support members 321 and 322 are each pivotally supported on the image forming apparatus 100. The positioning unit 300 is openable and closable about the pivotal support members 321 and 322 when the processing unit 400 is to be fitted on and removed from the image forming apparatus 100.

The detection switch 460 is capable of detecting the processing unit 400 in a brand-new state by being depressed by a depressing portion 410 provided on the processing unit 400 when the processing unit 400 is positioned by the positioning unit 300. The depressing portion 410 is equivalent to the acting portion defined by the present invention. Specifically, the detection switch 460 has a portion to be depressed by the depressing portion 410. When this portion is depressed, electrical contact is established to identify the processing unit 400 as a new one. When this portion remains undepressed, the processing unit 400 currently fitted on the image forming apparatus 100 is identified as an old one.

FIG. 7 includes views illustrating an end face of the photosensitive drum included in the processing unit of the image forming apparatus according to the embodiment of the present invention.

Figure 7B:
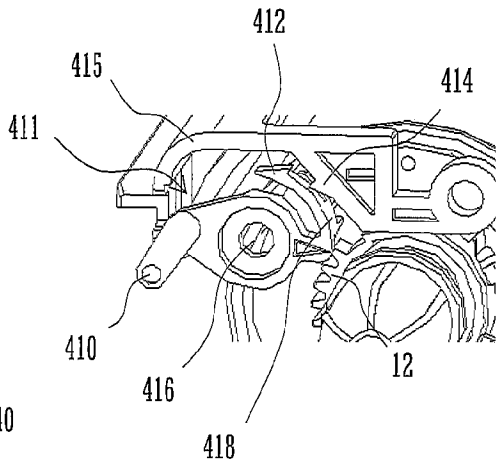
FIG. 7B is a fragmentary perspective view of the photosensitive drum shown in FIG. 7A.
Figure 7A:
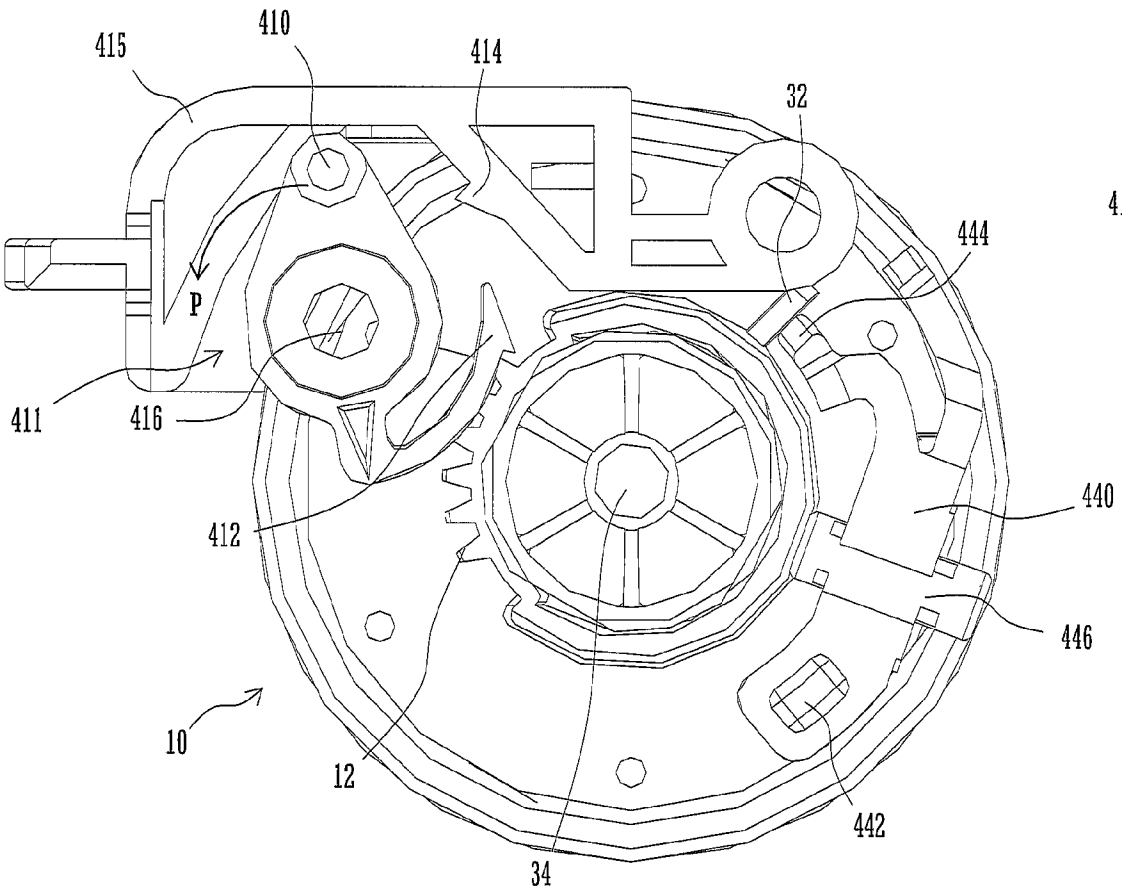
FIG. 7A is a view illustrating an end face of a photosensitive drum included in a processing unit of the image forming apparatus according to the embodiment of the present invention.

FIGS. 7A and 7B are views illustrating the photosensitive drum 10 from which a drum cover 450 covering the end face of the photosensitive drum 10 is omitted. The end face of the photosensitive drum 10 is equivalent to a rotating portion defined by the present invention. The end face of the photosensitive drum 10 is provided with a linkage gear 12 and a rotation stop 32. The drum cover 450 supports an initial detection gear 411 and a stopper shaft 446 thereon. The initial detection gear 411 is equivalent to the new/old detection member defined by the present invention. A frame 415 is attached to the photosensitive drum 10. A drum shaft 34 is in the form of a projection.

The initial detection gear 411 has a linkage gear 418 and is supported about a rotation support portion 416 for rotation in a manner linked to the linkage gear 12. The initial detection gear 411 also has the depressing portion 410 and an engaging portion 412. When the processing unit 400 is fitted on the image forming apparatus 100, the depressing portion 410 rotates irreversibly through a fixed angle in a direction indicated by arrow P in a manner linked to rotation of the photosensitive drum 10. The expression "to rotate irreversibly through a fixed angle" means that the depressing portion 410 cannot rotate backwardly by engagement between the engaging portion 412 and an engaged portion 414 to be described later after the depressing portion 410 has rotated by the fixed angle and fails to rotate through a larger angle than the fixed angle.

The frame 415 has the engaged portion 414. Once the engaging portion 412 engages the engaged portion 414, the engaging portion 412 prevents the depressing portion 410 from rotating in the direction opposite to the direction of arrow P to the position at which the depressing portion 410 would be detected again by the detection switch 460 after the linked rotation of the initial detection gear 411 has been ended. When the engaging portion 412 reaches a position at which it engages the engaged portion 414, the linkage gears 418 and 12 are disengaged from each other, so that the depressing portion 410 does not rotate any more. That is, the depressing portion 410 rotates irreversibly through the fixed angle in the direction of arrow P.

The initial detection gear 411 is used to identify the processing unit as a new one or an old one. The stopper shaft 446 elastically supports the stopper arm 440 so as to press the stopper arm 440 against the end face of the photosensitive drum 10. The stopper arm 440 is equivalent to the stopper defined by the present invention. The stopper arm 440 has a protuberance 442 and an arm 444. The rotation stop 32 prevents rotation of the photosensitive drum 10 by engagement with the stopper arm 440. The drum shaft 34, which projects axially of the photosensitive drum 10, is correctly positioned in the image forming apparatus 100 when fitted into the positioning unit 300.

FIG. 7 shows the end face of the photosensitive drum 10 which lies on the side on which the positioning unit 300 is located when the processing unit 400 is fitted on the image forming apparatus 100. When the positioning unit 300 is closed after the processing unit 400 has been fitted on the image forming apparatus 100, the initial detection gear 411 is brought into contact with the detection switch 460. Stated otherwise, when the positioning unit 300 is opened with the processing unit 400 in a state of being fitted on the image forming apparatus 100, the initial detection gear 411 becomes exposed and, hence, it is easy to visually check whether the initial detection gear 411 indicates a brand-new state or an old state.

Figure 8:
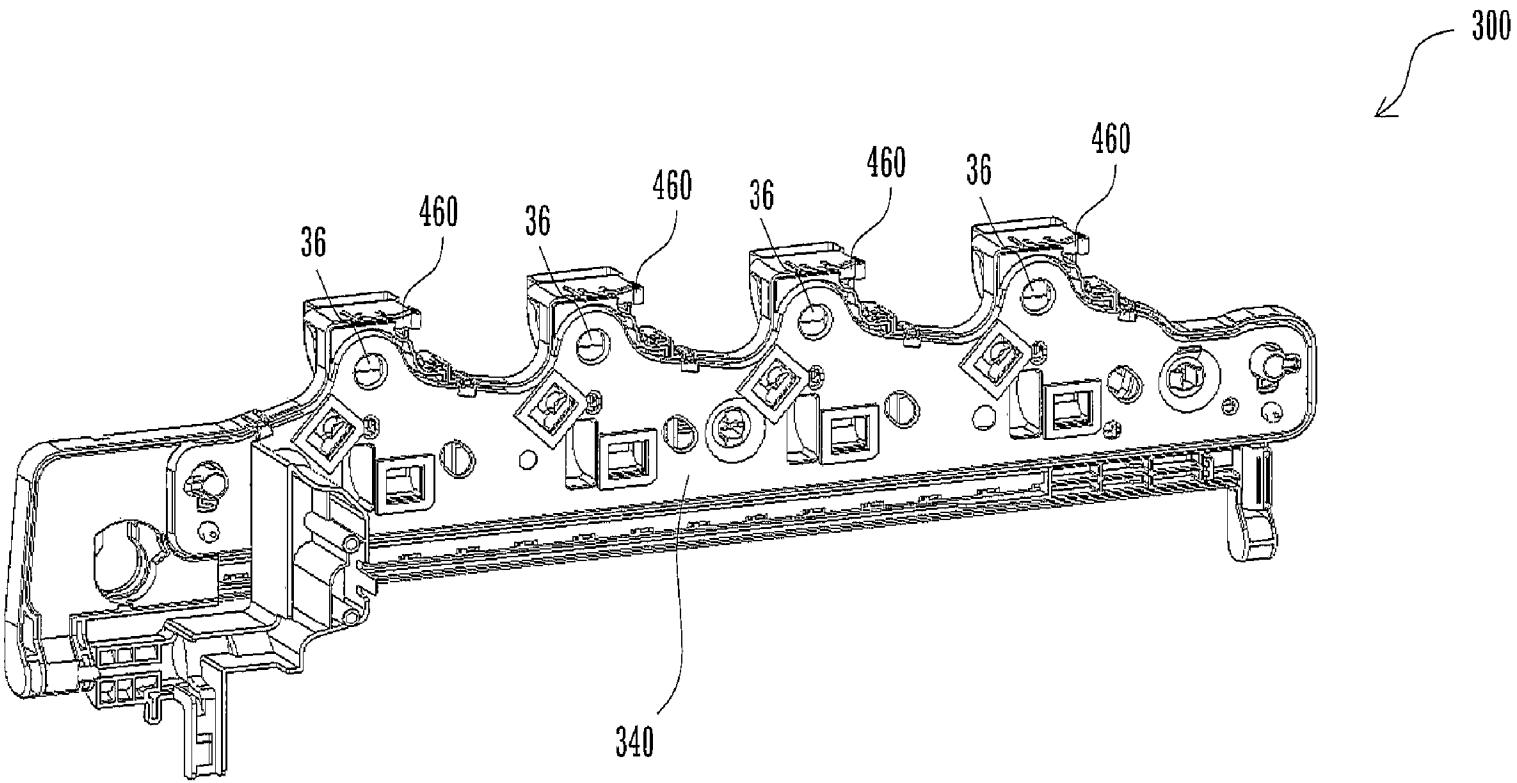
FIG. 8 is a view illustrating the positioning unit of the image forming apparatus according to the embodiment of the present invention.

FIG. 8 is a view illustrating the positioning unit of the image forming apparatus according to the embodiment of the present invention.

The positioning unit 300 has a fit portion 36. The positioning unit 300 is fitted on the image forming apparatus 100 after the processing unit 400 and the developing device 40 have been fitted on the image forming apparatus 100. At that time, the drum shaft 34 of the photosensitive drum 10 is fitted into the fit portion 36 of the positioning unit 300, thereby positioning the processing unit 400 correctly. Since the developing device 40 is in engagement with the processing unit 400, the developing device 40 is also positioned correctly.

Figure 9:
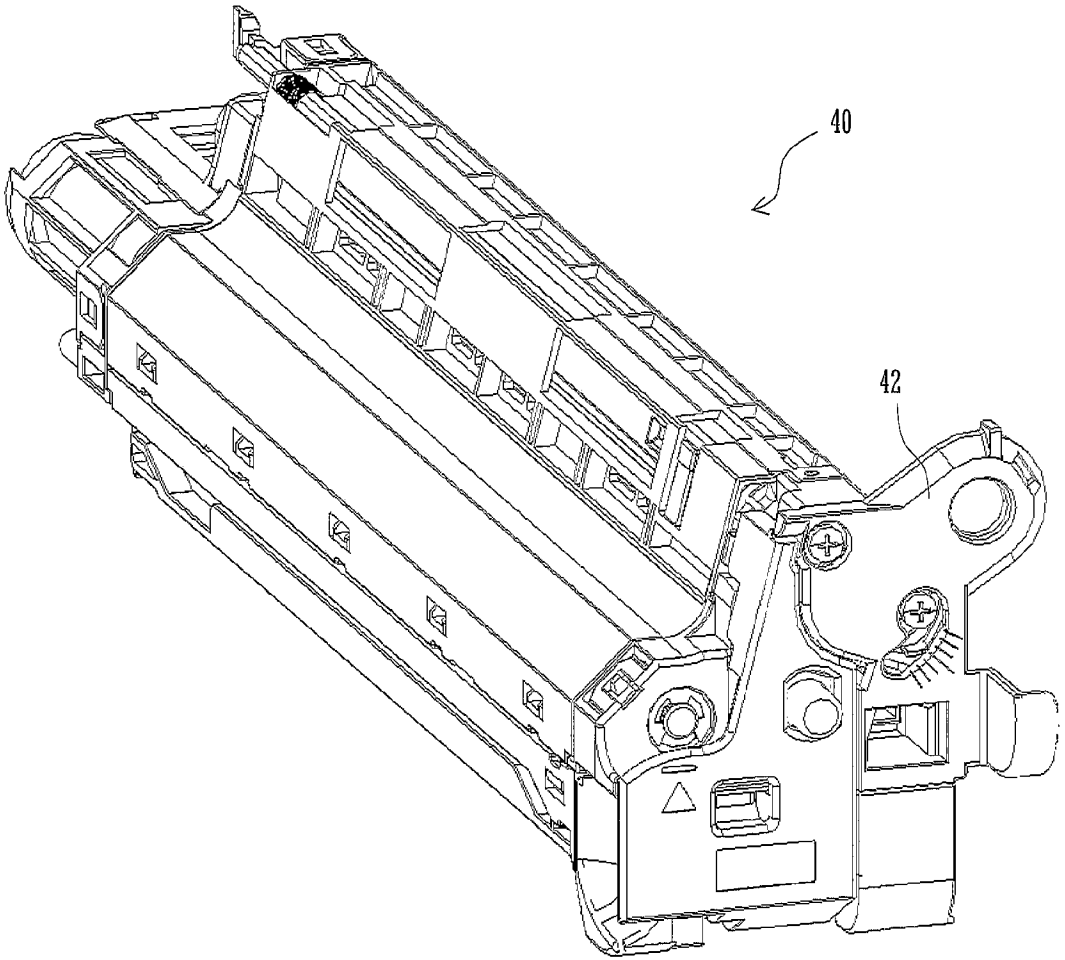
FIG. 9 is a view illustrating the developing unit of the image forming apparatus according to the embodiment of the present invention.

FIG. 9 is a view illustrating a developing unit of the image forming apparatus according to the embodiment of the present invention.

The developing device 40 has a side member 42. The side member 42 can be fitted in the processing unit 400. By such engagement between the developing device 40 and the processing unit 400, the spacing between the developing device 40 and the processing unit 400 is held constant, which ensures images of good quality stably.

Figure 10:
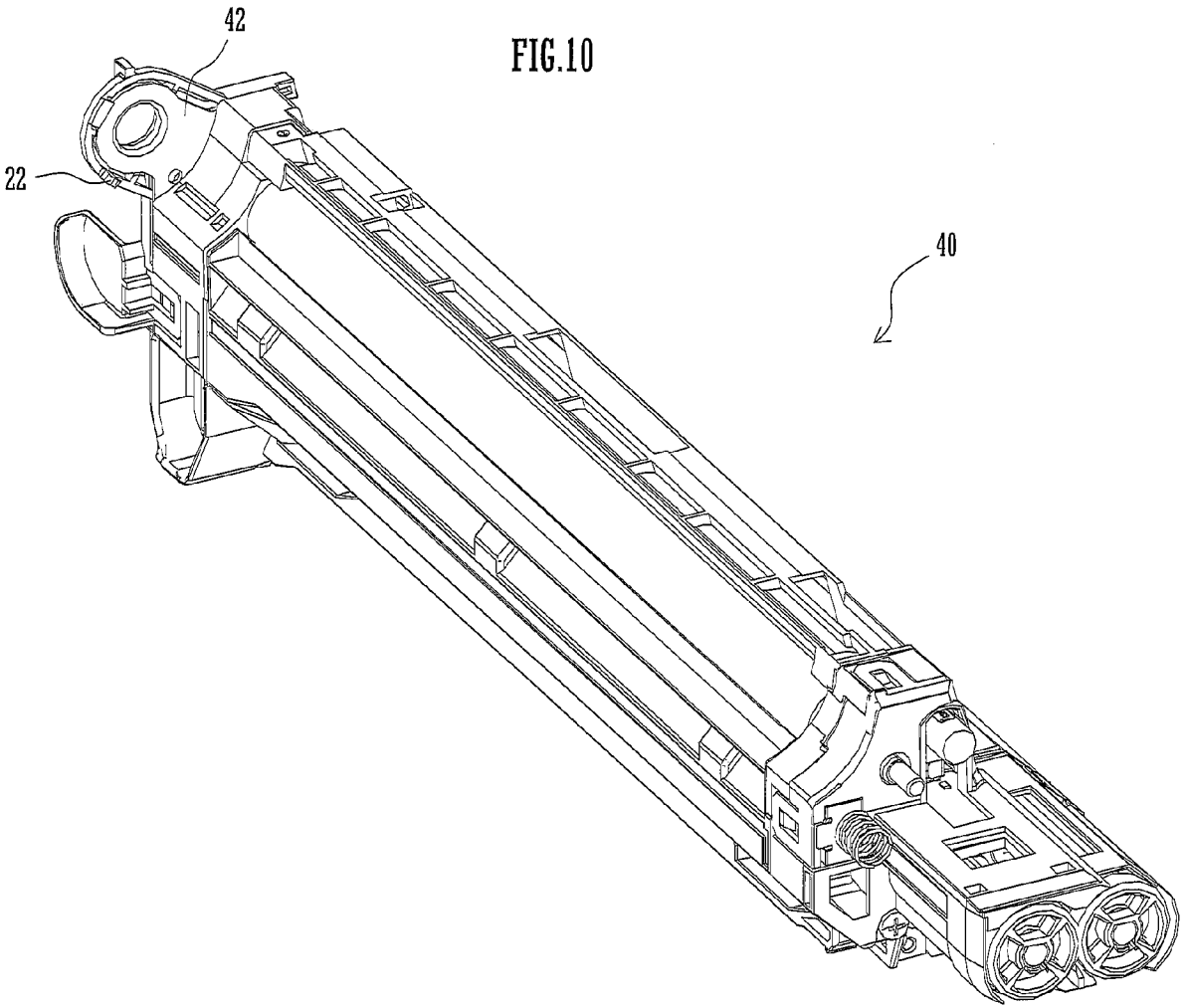
FIG. 10 is a view illustrating the developing unit of the image forming apparatus according to the embodiment of the present invention.

FIG. 10 is a view illustrating the developing unit of the image forming apparatus according to the embodiment of the present invention.

FIG. 10 illustrates the developing 40 as viewed from the direction opposite to the viewing direction of FIG. 9. The side member 42 has a stopper disengaging projection 22. The stopper disengaging projection 22 depresses the protuberance 442 when the developing device 40 engages the processing unit 400. Then, the arm 444 becomes spaced apart from the end face of the photosensitive drum 10 so as to be disengaged from the rotation stop 32, thus allowing the photosensitive drum 10 to rotate. This mechanism will be described later with reference to FIGS. 13 and 14.

Figure 11:
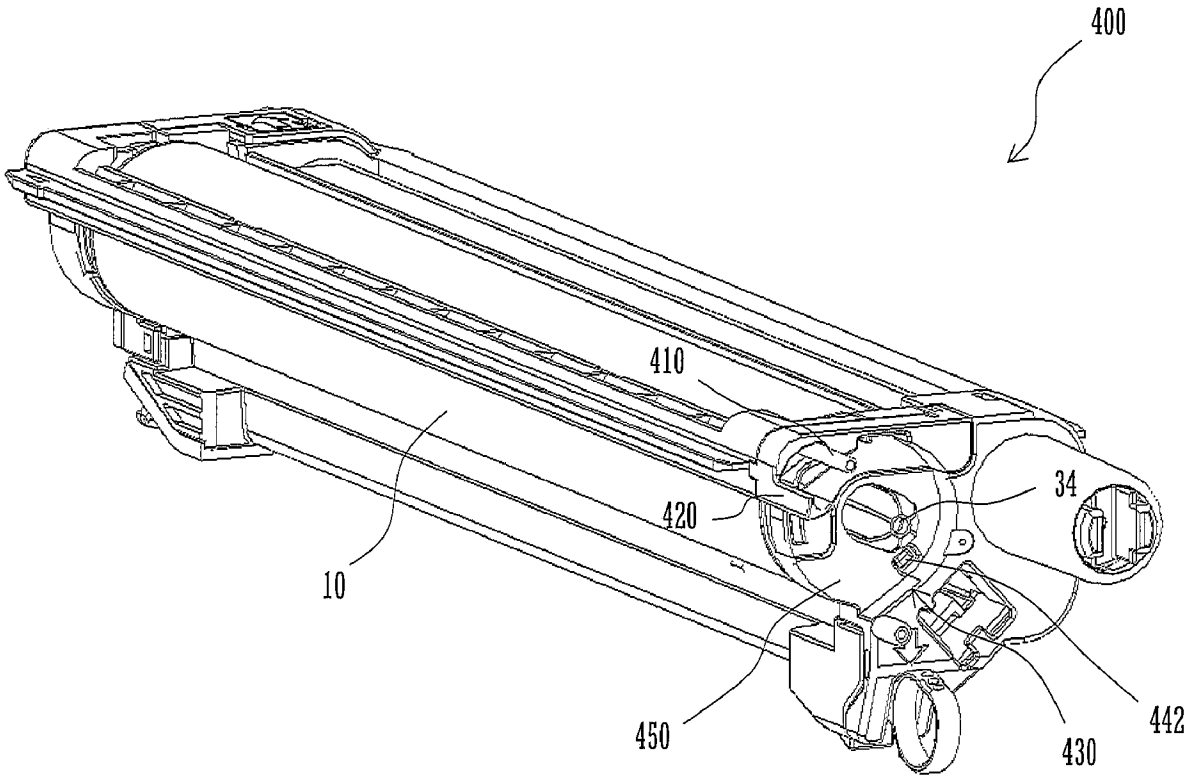
FIG. 11 is a view illustrating the processing unit of the image forming apparatus according to the embodiment of the present invention.

FIG. 11 is a view illustrating the processing unit of the image forming apparatus according to the embodiment of the present invention.

The processing unit 400 illustrated in FIG. 11 is a new one. The drum cover 450 is mounted on the processing unit 400. The drum cover 450 has a pad portion 420 and an opening portion 430. The pad portion 420 is a member for protecting the depressing member 410 from damage and the like. The opening portion 430 is positioned to expose the protuberance 442. The opening portion 430 thus positioned allows the stopper disengaging projection 22 to depress the protuberance 442 when the developing device 40 engages the processing unit 400.

FIG. 11 illustrates a state assumed before the initial detection gear 411 rotates in a manner linked to rotation of the photosensitive drum 10. With the initial detection gear 411 being in this state, when the processing unit 400 is positioned by the positioning unit 300 after having been fitted on the image forming apparatus 100, the depressing portion 410 depresses the detection switch 460, thus enabling the image forming apparatus 100 to identify the processing unit 400 as a new one.

The processing unit 400 has one end provided with a driving gear adapted to receive a driving force for driving components of the processing unit 400 and an opposite end provided with the initial detection gear 411. This arrangement makes it possible to secure a space for placing the initial detection gear 411 therein without increasing the size of the processing unit 400.

Figure 12:
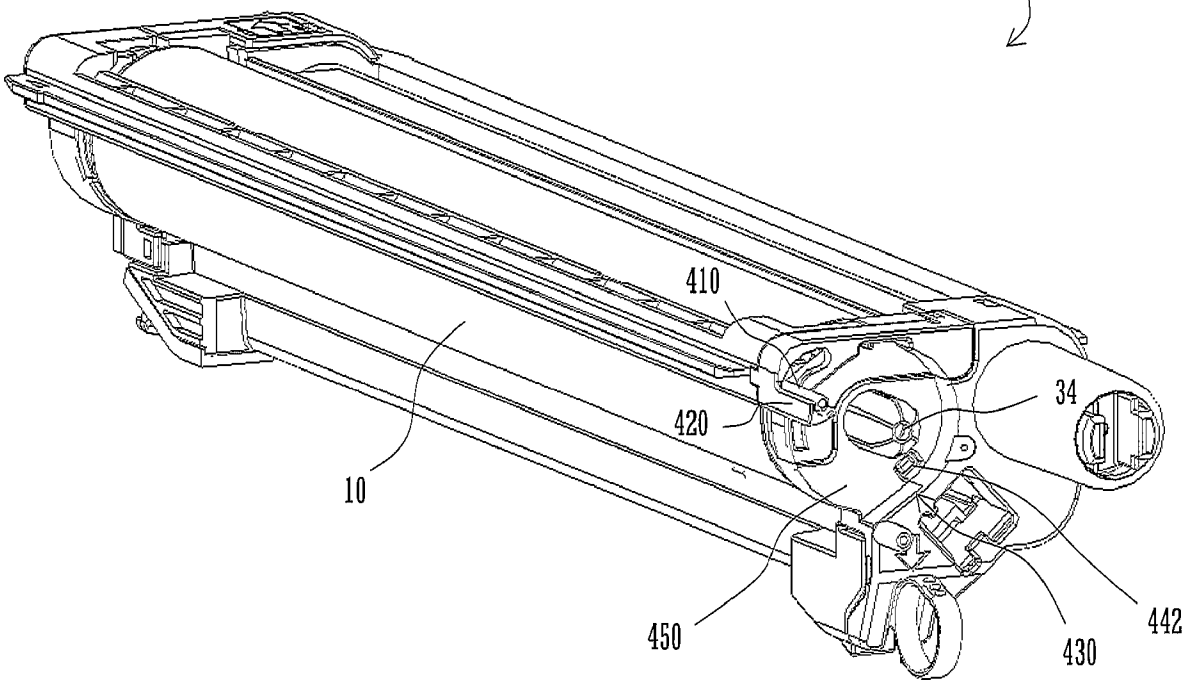
FIG. 12 is a view illustrating the processing unit of the image forming apparatus according to the embodiment of the present invention.

FIG. 12 is a view illustrating the processing unit of the image forming apparatus according to the embodiment of the present invention.

The processing unit 400 illustrated in FIG. 12 is an old one. When the developing unit 40 engages the processing unit 400, the stopper disengaging projection 22 depresses the protuberance 442 exposed from the opening portion 430 to disengage the arm 444 from the rotation stop 32, thus allowing the photosensitive drum 10 to rotate. Since the initial detection gear 411 rotates in a manner linked to rotation of the linkage gear 12, the depressing portion 410 moves to the location of the pad portion 420. When the depressing portion 410 has rotated to that location, the engaging portion 412 engages the engaged portion 414 to prevent the depressing portion 410 from rotating to the position at which the depressing portion 410 is detected by the detection switch 460. Therefore, the image forming apparatus 100 fails to identify the processing unit 400 as a new one.

FIG. 13 includes views illustrating the processing unit of the image forming apparatus according to the embodiment of the present invention.

Figures 13A, 13B:
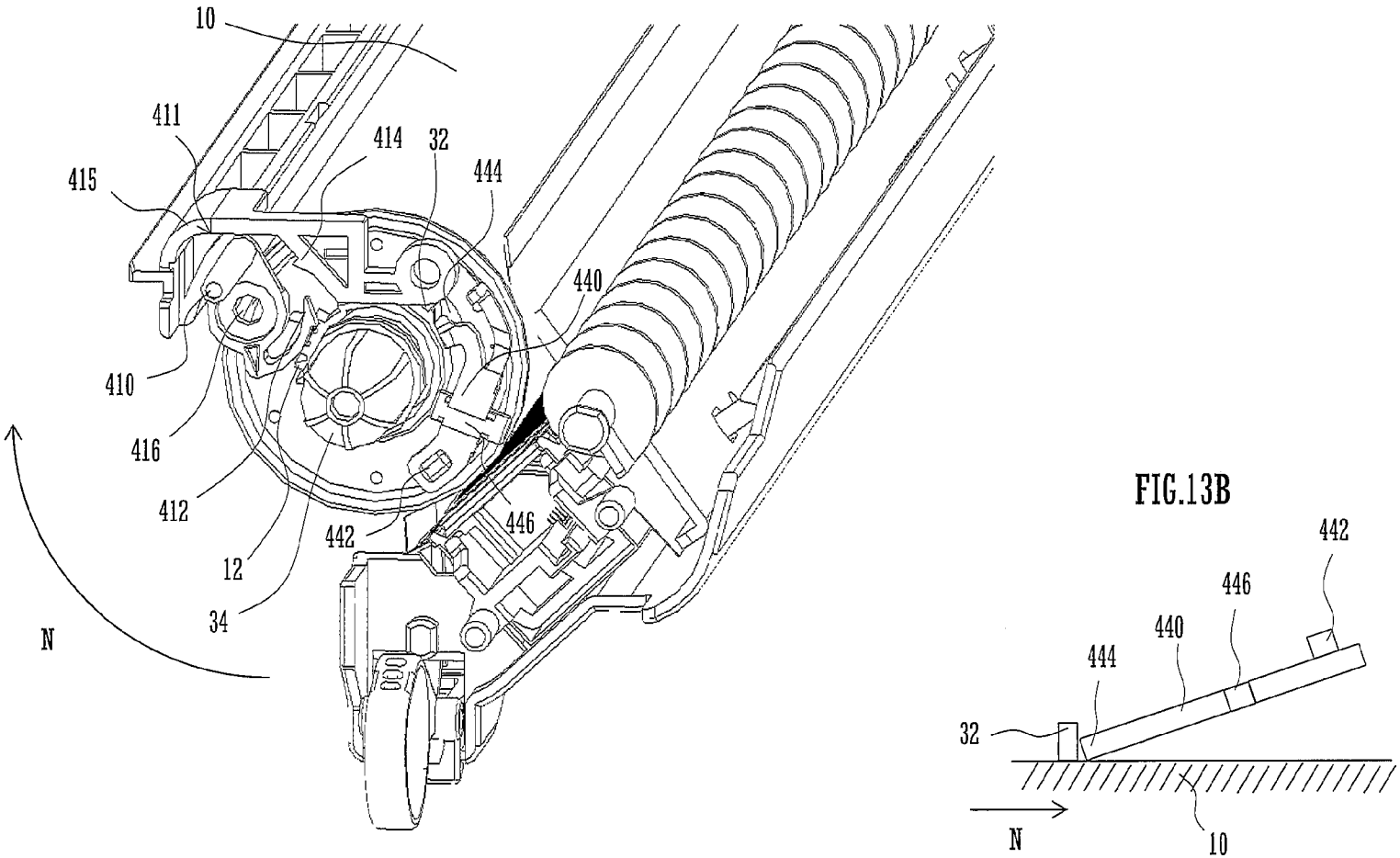
FIG. 13A is a view illustrating the processing unit of the image forming apparatus according to the embodiment of the present invention.
FIG. 13B is a view illustrating a state in which an arm and a rotation stop are in engagement with each other in the processing unit.

FIG. 13A illustrates the processing unit 400 from which the drum cover 450 is omitted. The processing unit 400 illustrated in FIG. 13A is a new one. FIG. 13B is a view illustrating a state in which the arm 444 and the rotation stop 32 are in engagement with each other. The strap-shaped stopper arm 440 has a central portion supported by the stopper shaft 446 incorporating a spring therein. The spring biases the stopper arm 440 so that the protuberance 442 side thereof is urged away from the photosensitive drum 10 while the arm 444 side thereof urged to contact the photosensitive drum 10. The photosensitive drum 10 is rotatable only in a direction of arrow N. The photosensitive drum 10 is prevented from rotating when the arm 444 engages the rotation stop 32.

FIG. 14 includes views illustrating the processing unit of the image forming apparatus according to the embodiment of the present invention.

Figure 14A:
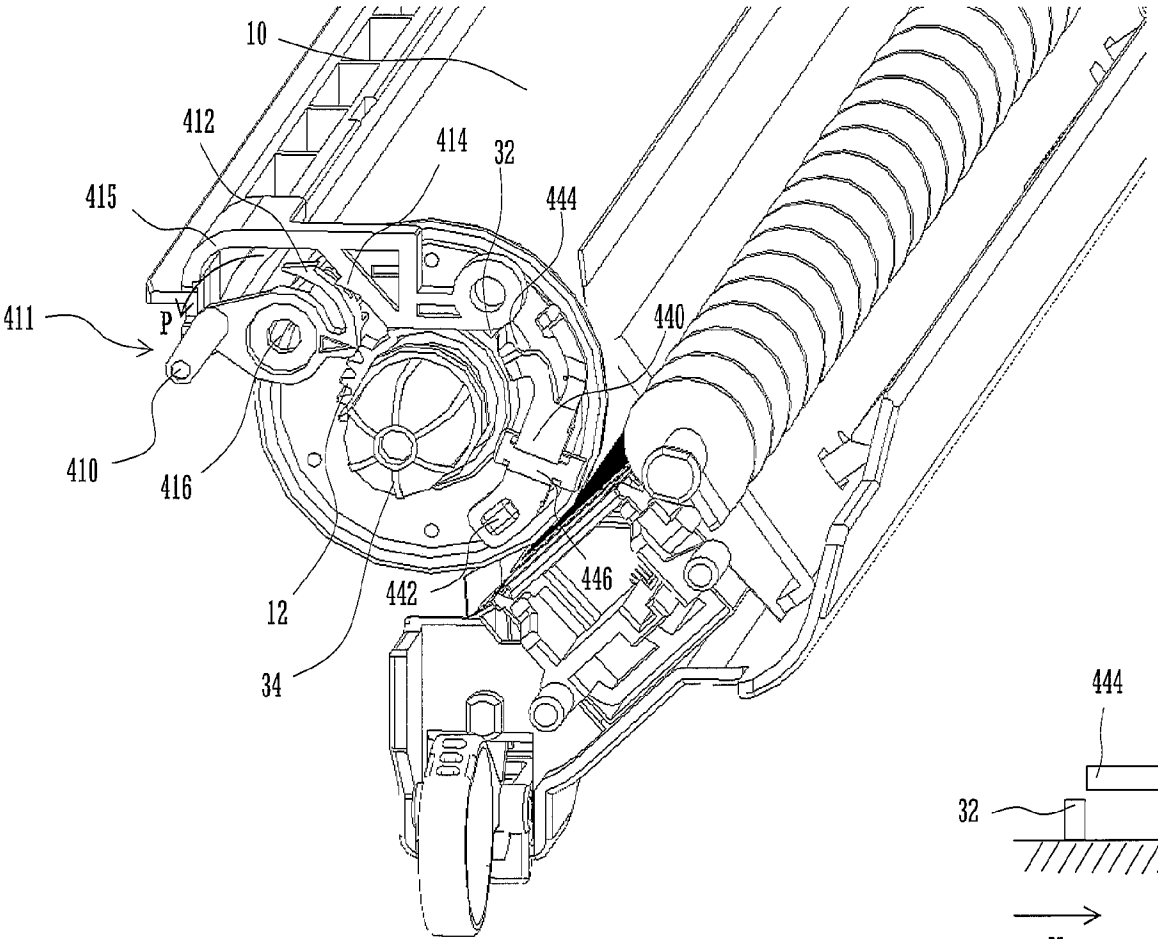
FIG. 14A is a view illustrating the processing unit of the image forming apparatus according to the embodiment of the present invention.
Figure 14B:
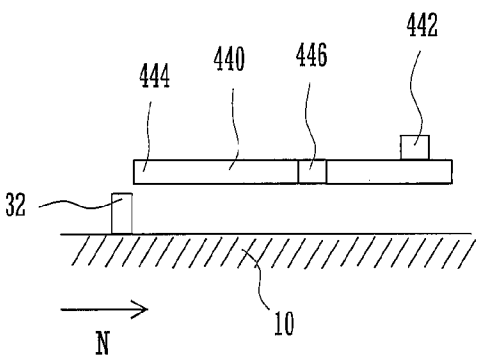
FIG. 14B is a view illustrating a state in which the arm and the rotation stop are disengaged from each other in the processing unit.

FIG. 14A illustrates the processing unit 400 from which the drum cover 450 is omitted. The processing unit 400 illustrated in FIG. 14A is an old one. FIG. 14B is a view illustrating a state in which the arm 444 and the rotation stop 32 are disengaged from each other. The initial detection gear 411 has the linkage gear 418. When the processing unit 400 is a new one, the linkage gear 418 is in a state of meshing with the linkage gear 12. Since the arm 444 becomes spaced apart from the photosensitive drum 10 when the stopper disengaging projection 22 depresses the protuberance 442, the arm 444 is disengaged from the rotation stop 32 to allow the photosensitive drum 10 to rotate. Therefore, when the arm 444 is disengaged from the rotation stop 32, the initial detection gear 411 rotates in the direction of arrow P with rotation of the photosensitive drum 10 in a linked manner.

Though the rotation stop 32 also rotates with rotation of the photosensitive drum 10, any member does not interfere with rotation of the rotation stop 32 because the stopper shaft 446 is spaced apart from the photosensitive drum 10, as shown in FIG. 14B. When the initial detection gear 411 rotates to pass through a predetermined position, the engaging portion 412 engages the engaged portion 414 to prevent the initial detection gear 411 from rotating in the direction opposite to the direction of arrow P. Thus, the depressing portion 410 is fixed at the position shown, which allows the image forming apparatus 100 to identify the processing unit 400 as an old one.

Figure 15:
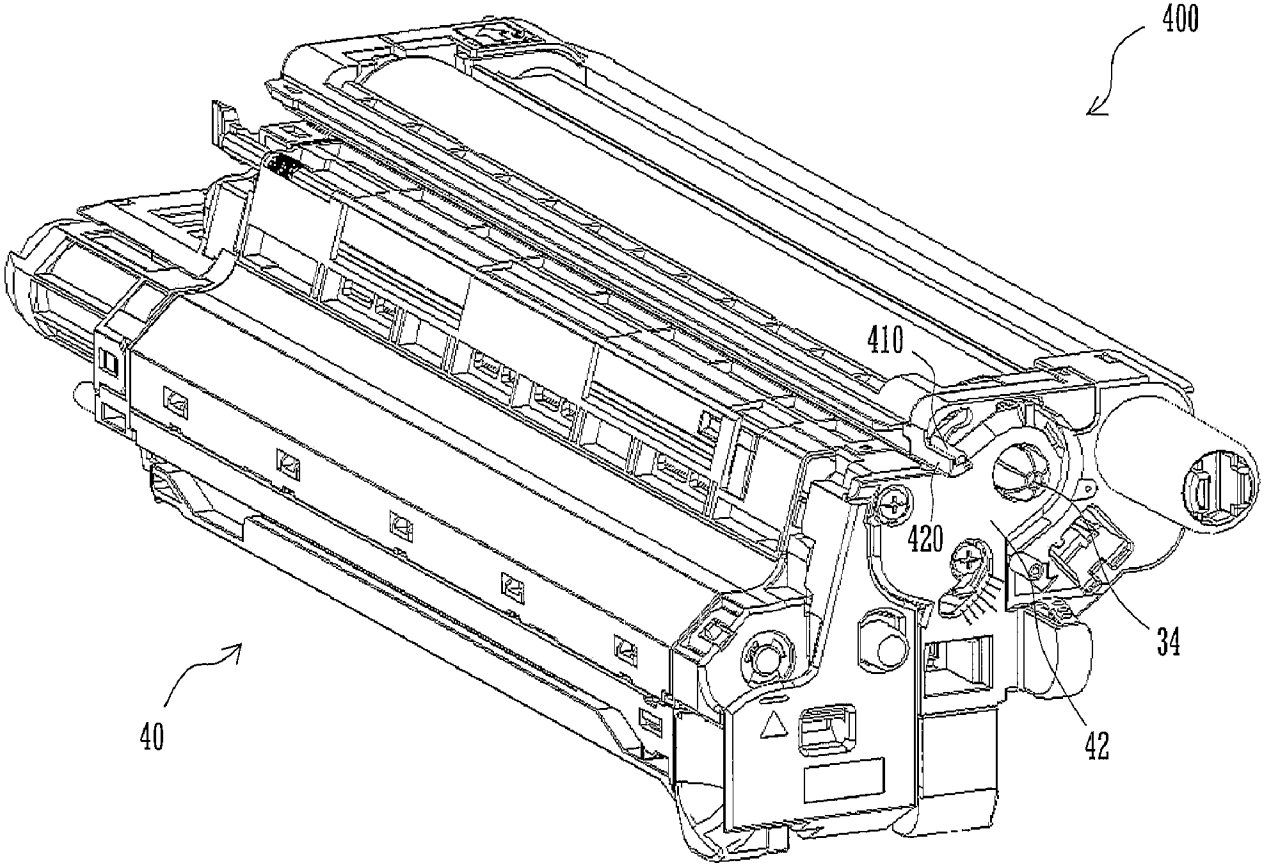
FIG. 15 is a view illustrating a state in which the developing unit is in engagement with the processing unit of the image forming apparatus according to the embodiment of the present invention.

FIG. 15 is a view illustrating a state in which the developing device is in engagement with the processing unit in the image forming apparatus according to the embodiment of the present invention.

When the side member 42 is fitted into the drum cover 450, the processing unit 400 and the developing device 40 are substantially positioned relative to each other. Therefore, when the processing unit 400 and the developing device 40 are fitted on the image forming apparatus 100, the processing unit 400 and the developing device 40 fail to totter, thus ensuring formation of high quality images. In fitting the processing unit 400 and the developing device 40 on the image forming apparatus 100, the developing device 40 is fitted after the processing unit 400 has been fitted on the image forming apparatus 100. By fitting the processing unit 400 and the developing device 40 on the image forming apparatus 100 in that order, the initial detection gear 411 fails to rotate by accident during the operation of fitting the processing unit 400 on the image forming apparatus 100.

Figure 16:
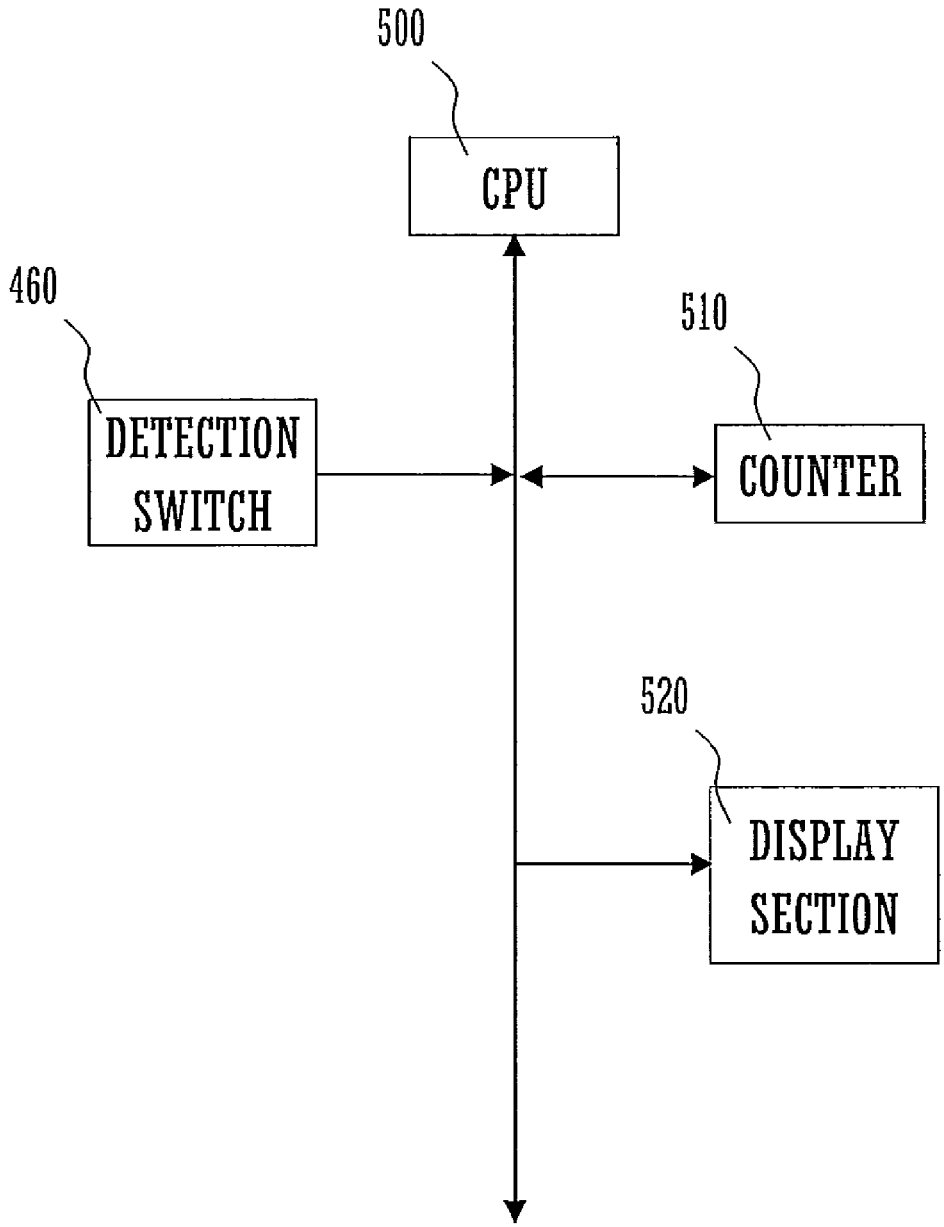
FIG. 16 is a block diagram of a portion of concern of the image forming apparatus according to the embodiment of the present invention.

FIG. 16 is a block diagram of a portion of concern of the image forming apparatus according to the embodiment of the present invention. This block diagram shows only the portion related to the present invention.

A CPU 500 is connected to each of the detection switch 460, counter 510 and display section 520. The detection switch 460 generates an ON signal when depressed by the depressing portion 410. The counter 510 measures the size of recording sheets that are subjected to printing after new processing unit 400 has been fitted on the image forming apparatus 400 and counts the number of such recording sheets. The display section 520 displays various information items on the image forming apparatus 100.

When the detection switch 460 has been depressed by the depressing portion 410, the information about this fact is transmitted to the CPU 500, which in turn transmits a signal instructing the counter 510 to reset its counted value. When the counted value of the counter 510 has reached a predetermined value, the information about this fact is transmitted to the CPU 500, which in turn transmits a signal instructing the display section 520 to display information to the effect that replacement of the processing unit 400 is required.

Figure 17:
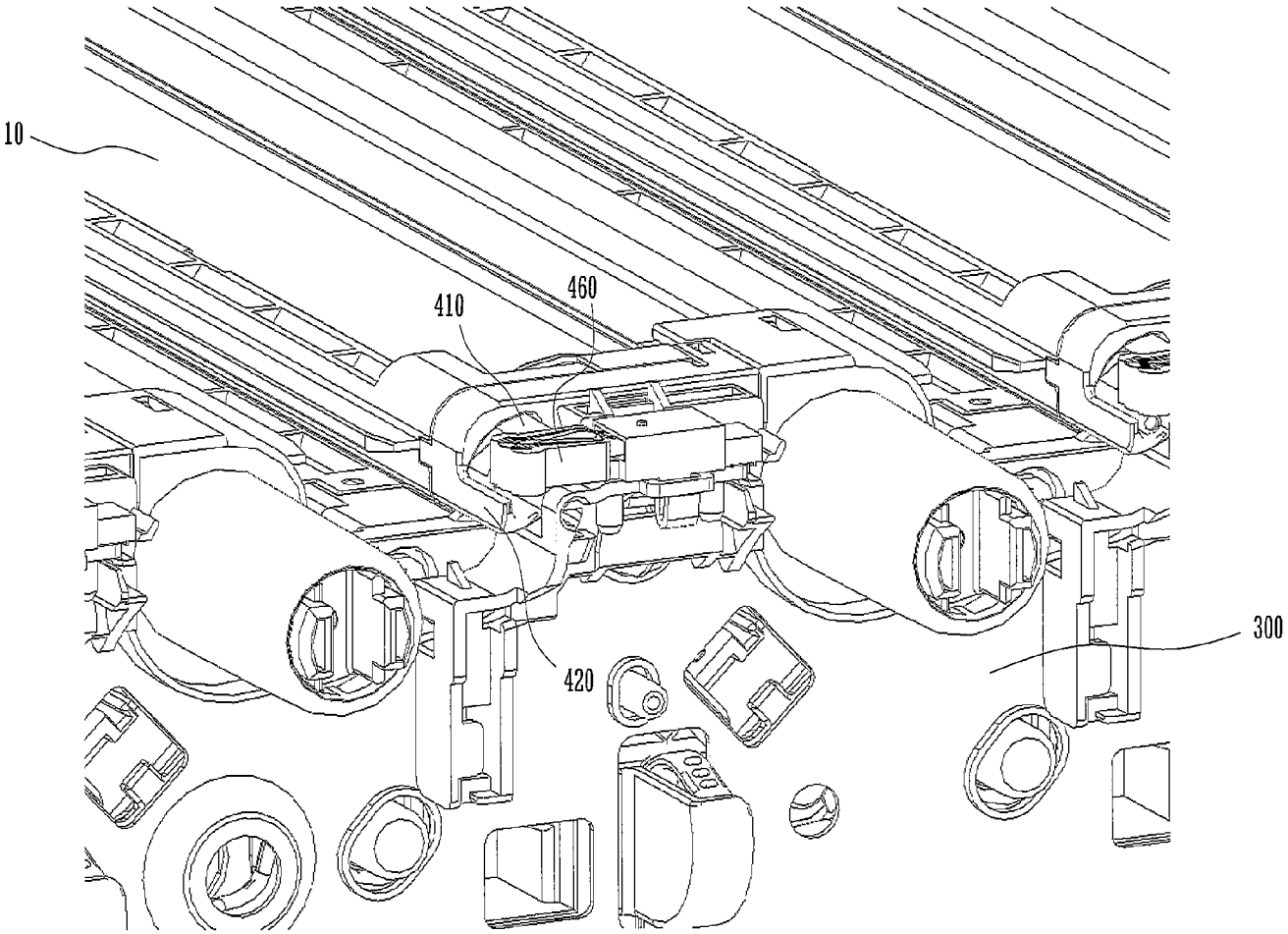
FIG. 17 is a view illustrating a state in which unused processing unit 400 has just been fitted on image forming apparatus 100.

FIG. 17 is a view illustrating the processing unit in a state of being fitted on the image forming apparatus according to the embodiment of the present invention.

FIG. 17 illustrates a state in which the processing unit 400 in an unused condition has just been fitted on the image forming apparatus 100. In FIG. 17, the obverse member 330 is omitted from the positioning unit 300 to show the detection switch 460. As already described, the positioning unit 300 has the detection switch 460.

The following is the procedure for fitting the processing unit 400 and the developing device 40 on the image forming apparatus 100. Initially, the processing unit 400 is fitted on the image forming apparatus 100. Subsequently, the developing device 40 is fitted on the image forming apparatus 100 so as to engage the processing unit 400. Finally, the processing unit 400 and the developing device 40 are positioned in and fixed to the image forming apparatus 100 by the positioning unit 300.

When the processing unit 400 and the developing device 40 are fixed to the image forming apparatus 100 by the positioning unit 300, the detection switch 460 is depressed by the depressing portion 410. Upon depression by the depressing portion 410, the detection switch 460 generates an ON signal which causes the image forming apparatus 100 to identify the processing unit 400 as a new one.

Figure 18:
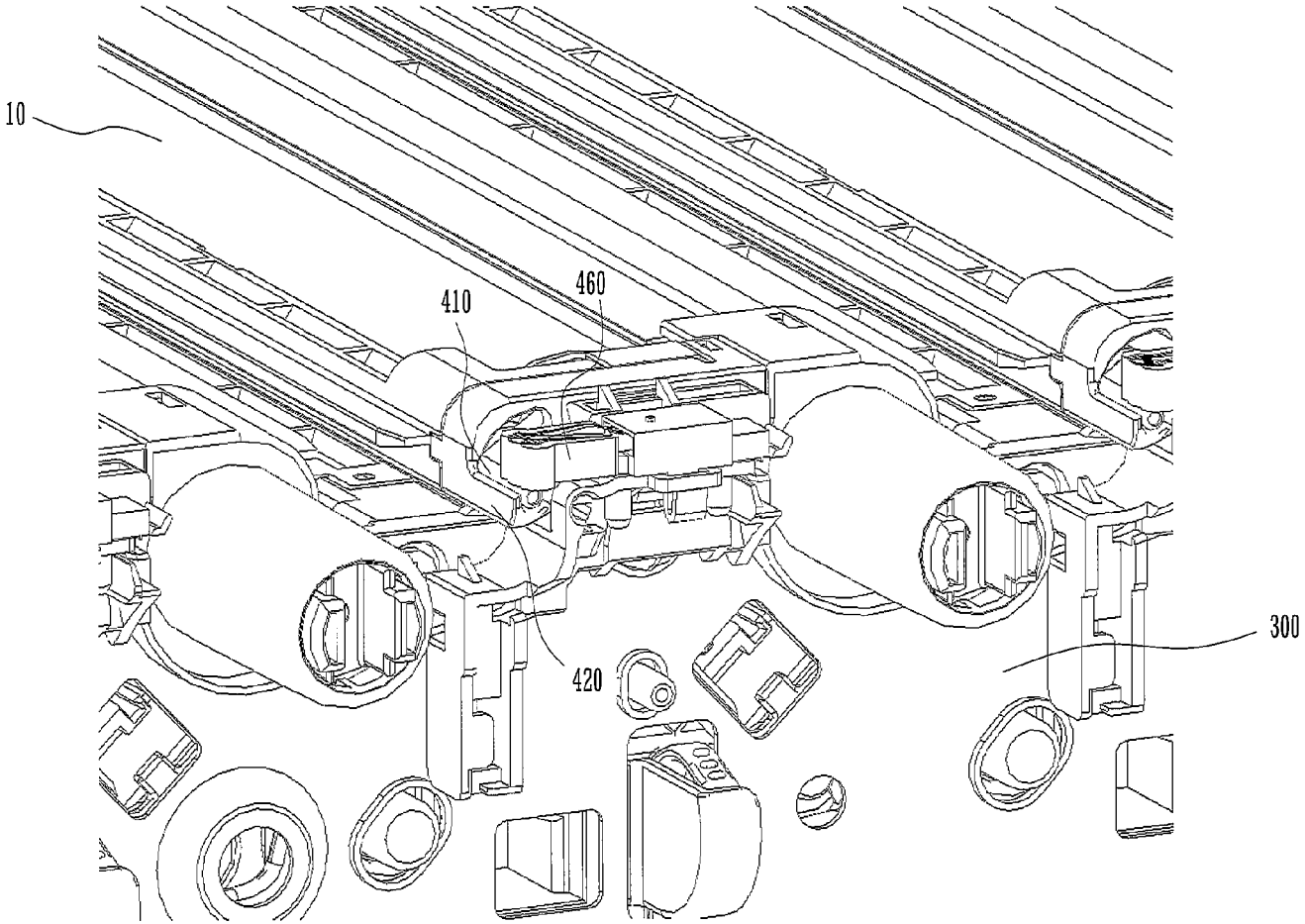
FIG. 18 is a view illustrating a state assumed when the processing unit fitted on the image forming apparatus according to the embodiment of the present invention starts being used.

FIG. 18 is a view illustrating a state assumed when the processing unit fitted on the image forming apparatus according to the embodiment of the present invention starts being used.

When use of the processing unit 400 is started, the initial detection gear 411 rotates with rotation of the photosensitive drum 10 in a linked manner to move the depressing portion 410 to the location of the pad portion 420. When the depressing portion 410 reaches that location, the linked rotation of the initial detection gear 411 is ended. Since the depressing portion 410 at that location fails to depress the detection switch 460, the counter 510 is not reset. When the depressing portion 410 is at that location, the engaging portion 412 engages the engaged portion 414 to end the linked rotation of the initial detection gear 411. For this reason, even when the processing unit 400 is again fitted on the image forming apparatus 100 after temporary removal of the processing unit 400 from the image forming apparatus 100, the depressing portion 410 fails to return to its original position. Therefore, the depressing portion 410 fails to depress the detection switch 460 again. Accordingly, the counter 510 correctly counts the number of uses of the processing unit 400 even when the processing unit 400 is repeatedly removed from and fixed on the image forming apparatus 100.

The foregoing embodiment is illustrative in all points and should not be construed to limit the present invention. The scope of the present invention is defined not by the foregoing embodiment but by the following claims. Further, the scope of the present invention is intended to include all modifications within the scopes of the claims and within the meanings and scopes of equivalents.

What is claimed is:

1. A processing unit comprising:

a photoreceptor configured to form an electrostatic latent image on a surface thereof;

a new/old detection member having an acting portion which rotates irreversibly through a fixed angle in a manner linked to rotation of the photoreceptor when a processing unit body including the photoreceptor is fitted on an image forming apparatus body, the new/old detection member enabling the image forming apparatus body to identify the processing unit as a new one or an old one according to whether or not the acting portion is detected by the image forming apparatus body;

a rotation stop provided on the photoreceptor; and a stopper for preventing the photoreceptor from rotating by engaging the rotation stop, wherein the photoreceptor is allowed to rotate again when the rotation stop and the stopper are disengaged from each other.

2. An image forming apparatus comprising:

the processing unit recited in claim 1; and a developing unit which is engageable with the processing unit.

3. The image forming apparatus according to claim 2, wherein the developing unit has a disengaging mechanism for disengaging the stopper from the rotation stop.

4. The image forming apparatus according to claim 3, wherein the developing unit is fitted on the image forming apparatus body after the processing unit has been fitted on the image forming apparatus body.

5. An image forming apparatus comprising:

a processing unit which is replaceably usable in an image forming apparatus body, the processing unit having a photoreceptor; and a positioning unit configured to position the processing unit in the image forming apparatus body, wherein:

the processing unit includes a new/old detection member having an acting portion which rotates irreversibly through a fixed angle in a manner linked to rotation of the photoreceptor when the processing unit is fitted on the image forming apparatus body, the new/old detection member enabling the image forming apparatus body to identify the processing unit as a new one or an old one according to whether or not the acting portion is detected by the image forming apparatus body; and the positioning unit has a detection mechanism capable of detecting the processing unit in a brand-new state by being acted by the acting portion when the processing unit is positioned in the image forming apparatus body.

6. The image forming apparatus according to claim 5, wherein the positioning unit has an opening and closing mechanism which is openable and closable when the processing unit is to be fitted on and removed from the image forming apparatus body.

7. The image forming apparatus according to claim 5, wherein the processing unit has a pad portion for protecting the new/old detection member.

8. The image forming apparatus according to claim 5, wherein the photoreceptor has a linkage gear for causing the new/old detection member to rotate in a manner linked to a rotating portion of the photoreceptor.

9. The image forming apparatus according to claim 5, wherein:

the new/old detection member has an engaging portion for preventing the acting portion from rotating to a position at which the acting portion depresses the detection mechanism after the linked rotation of the new/old detection member has been ended; and the processing unit has an engaged portion for engagement with the engaging portion.

10. The image forming apparatus according to claim 5, wherein:

the processing unit has the new/old detection mechanism provided on a surface thereof which lies on a side on which the positioning unit is located when the processing unit is fitted on the image forming apparatus body; and the new/old detection member is configured to be brought into contact with the detection mechanism when the positioning unit is closed with the processing unit in a state of being fitted on the image forming apparatus body.

11. The image forming apparatus according to claim 5, wherein the processing unit has one end provided with a driving gear configured to receive a driving force for driving components of the processing unit and an opposite end provided with the new/old detection member.

* * * * *